US007677916B2

(12) United States Patent
Chang

(10) Patent No.: US 7,677,916 B2
(45) Date of Patent: Mar. 16, 2010

(54) POWER PLUG ASSEMBLY

(75) Inventor: Hsing-Wang Chang, Shenkeng Township, Taipei County (TW)

(73) Assignee: Taiwan Line Tek Electronic Co., Ltd., Taipei County (TW)

( * ) Notice: Subject to any disclaimer, the term of this patent is extended or adjusted under 35 U.S.C. 154(b) by 161 days.

(21) Appl. No.: 12/081,383

(22) Filed: Apr. 15, 2008

(65) Prior Publication Data

US 2009/0215323 A1 Aug. 27, 2009

(30) Foreign Application Priority Data

Feb. 20, 2008 (TW) ..... 97202976 U

(51) Int. Cl.
*H01R 3/00* (2006.01)

(52) U.S. Cl. ..... 439/490; 439/675; 439/620.22

(58) Field of Classification Search ..... 439/675, 439/730, 620.22, 578, 588, 695
See application file for complete search history.

(56) References Cited

U.S. PATENT DOCUMENTS 4,431,254 A * 2/1984 Cartesse ..... 439/607.52
4,869,690 A * 9/1989 Frear et al. ..... 439/675
5,857,867 A * 1/1999 Henry ..... 439/290
6,572,402 B2 * 6/2003 Lin ..... 439/490
6,743,044 B2 * 6/2004 Musolf et al. ..... 439/490
7,168,975 B2 * 1/2007 Kuo ..... 439/490
7,607,937 B1 * 10/2009 Chang ..... 439/490
2009/0280679 A1 * 11/2009 Chang ..... 439/490

* cited by examiner

*Primary Examiner*—Neil Abrams
*Assistant Examiner*—Harshad C Patel
(74) *Attorney, Agent, or Firm*—Guice Patents PLLC

(57) ABSTRACT

The present invention relates to a power plug assembly, comprises a cable having two power wires, end sections of each wire has plural conductive metal wires; a terminal set composed by a positive terminal and a negative terminal, a connecting section is respectively provided to the rear ends of the positive and the negative terminals and the connecting sections are respectively connected to plural conductive metal wires of end sections of the power wires, the surfaces of the positive and the negative terminals are provided with welding holes; a conductive sleeve tube having an inner tube and an outer tube, an insulating material is provided between the inner tube and the outer tube for insulation; after the two terminals are respectively provided on the outer tube and the inner tube of the conductive sleeve tube, a welding operation is processed and the welding material passes through the welding holes so the two terminals are connected and retained on the conductive sleeve tube; an outer covering member formed by a plastic injection molding and the rear portion of the conductive sleeve tube, the terminal set and the front portion of the cable are covered by the outer covering member via the plastic injection molding. With the improved connecting method of the cable, the terminal set and the conductive sleeve tube provided by the present invention, the connecting strength and the welding speed are increased, and the defective rate is lower and the quality can be ensured.

14 Claims, 5 Drawing Sheets

POWER PLUG ASSEMBLY

FIELD OF THE INVENTION

The present invention relates to a power plug assembly, more particularly to a power plug assembly in which a connecting fashion of cables and a conductive sleeve tube is improved and the connection is therefore enhanced.

DESCRIPTION OF RELATED ART

A power plug is commonly seen in our daily life. Categorized by functions, a power plug can be a power-receiving plug or a power-supplying plug, wherein the power-receiving plug is mostly an AC plug with two or three electrodes for receiving supplying power; the power-supplying plug is a DC plug having a shape like a round column, the diameter of the power-supplying plug is varied according to a diameter of power plug of an electronic goods, e.g. a note book computer or a cell phone.

As shown in FIG. 1, which is a schematic view of a connection of a cable 10 of a conventional power-supplying plug and a conductive sleeve tube 20, the cable 10 includes two power wires 101, 102 respectively having positive and negative electricity and providing the cable 10 with a function of signal transferring, the cable 10 can be further provided with a signal wire 103. In order to connecting end sections of the wires of the cable 10 to the conductive sleeve tube 20, wires respectively having positive and negative electricity are welded on corresponding locations of the conductive sleeve tube 20, so an outer tube 201 and an inner tube 202 of the conductive sleeve tube 20 are respectively provided with functions of outputting negative and the positive electricity.

Speaking of fashions of connection, an welding operation is an inevitable process for a power-supplying plug, but disadvantages of such art is that when plural exposed copper wires at the end sections of the wires are welded on the conductive sleeve tube 20, the tin points of the welding locations are relatively too big, so when an operation of embedded-type plastic injection molding is processed, the mold of the plastic injection molding will press on the welded tin points or even break the copper wires, a malfunction product is therefore formed. After the plural copper wires at the end sections of the wires are pressed by welding tools, the wires will be in a spread-out status so the welding operation is harder to proceed.

SUMMARY OF THE INVENTION

The applicant of the present invention has devoted himself to design and commercially distribute power plus, power sockets and cables and been trying to overcome the disadvantages of directly welding the cable of the power plug assembly on the conductive sleeve tube as mentioned above; and by overcoming the disadvantages, the connecting strength of the cable and the conductive sleeve tube can be enhanced; after try and error the present invention of power plug assembly is provided.

One object of the present invention is to overcome disadvantages that welding points formed during an welding operation processed on a conventional cable and a conductive sleeve tube are relatively too big and plural copper wires are in a spread-out status so the welding operation is harder to proceed, the present invention provides a fashion that terminals are connected to end sections of wires of a cable in advance, then the terminals are respectively welded on corresponding locations of a conductive sleeve tube so the connecting strength is enhanced. With the welding fashion provided by the present invention, following advantages are achieved: a.) effectively reducing sizes of tin points at the welding locations, b.) welding of the terminals and the conductive sleeve tube is easier so the welding speed and the production capacity are increased, and c.) by providing retaining members on a positive and a negative terminals, a printed circuit board or any other functional electronic unit, e.g. a LED or a detecting IC for indicating or detecting, can be provided between the positive and the negative terminals.

To achieve objects mentioned above, one art provided by the present invention is to provide a power plug assembly, comprises a cable having two power wires, end sections of each wire has plural conductive metal wires; a terminal set composed by a positive terminal and a negative terminal, a connecting section is respectively provided to the rear ends of the positive and the negative terminals and the connecting sections are respectively connected to plural conductive metal wires of end sections of the power wires, the surfaces of the positive and the negative terminals are provided with welding holes; a conductive sleeve tube having an inner tube and an outer tube, an insulating material is provided between the inner tube and the outer tube for insulation; after the two terminals are respectively provided on the outer tube and the inner tube of the conductive sleeve tube, a welding operation is processed and the welding material passes through the welding holes so the two terminals are connected and retained on the conductive sleeve tube; an outer covering member formed by a plastic injection molding and the rear portion of the conductive sleeve tube, the terminal set and the front portion of the cable are covered by the outer covering member via the plastic injection molding.

Another art provided by the present invention is to provide a power plug assembly, comprises a cable having two power wires, end sections of each wire has plural conductive metal wires; a terminal set composed by a positive terminal and a negative terminal, a connecting section is respectively provided to the rear ends of the positive and the negative terminals and the connecting sections are respectively connected to plural conductive metal wires at the end sections of the power wires, the surfaces of the positive and the negative terminals are provided with welding holes; a printed circuit board provided across the positive and the negative terminals so as to establish a circuit, and the circuit is coupled with a functional electronic unit, a conductive sleeve tube having an inner tube and an outer tube, an insulating material is provided between the inner tube and the outer tube for insulation; after the two terminals are respectively provided on the outer tube and the inner tube of the conductive sleeve tube, a welding operation is processed and the welding material passes through the welding holes so the two terminals are connected and retained on the conductive sleeve tube; an outer covering member formed by a plastic injection molding and the rear portion of the conductive sleeve tube, the terminal set and the front portion of the cable are covered by the outer covering member via the plastic injection molding.

DETAILED DESCRIPTION OF THE PREFERRED EMBODIMENT

Figure 1:
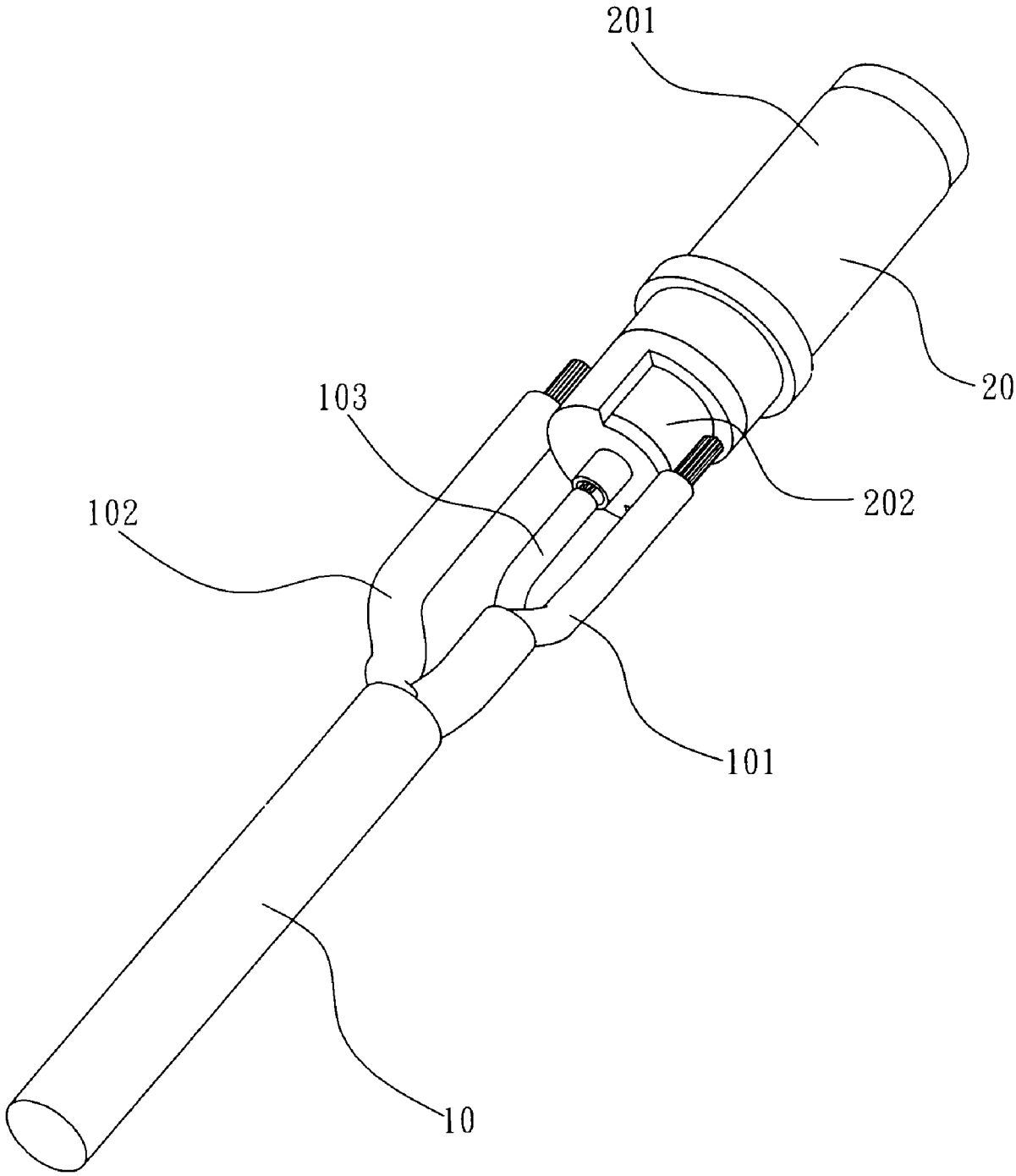
(PRIOR ART) FIG. 1
FIG. 1 is a schematic view of a connection of a cable of a conventional power plug assembly and a conductive sleeve tube.
Figure 2:
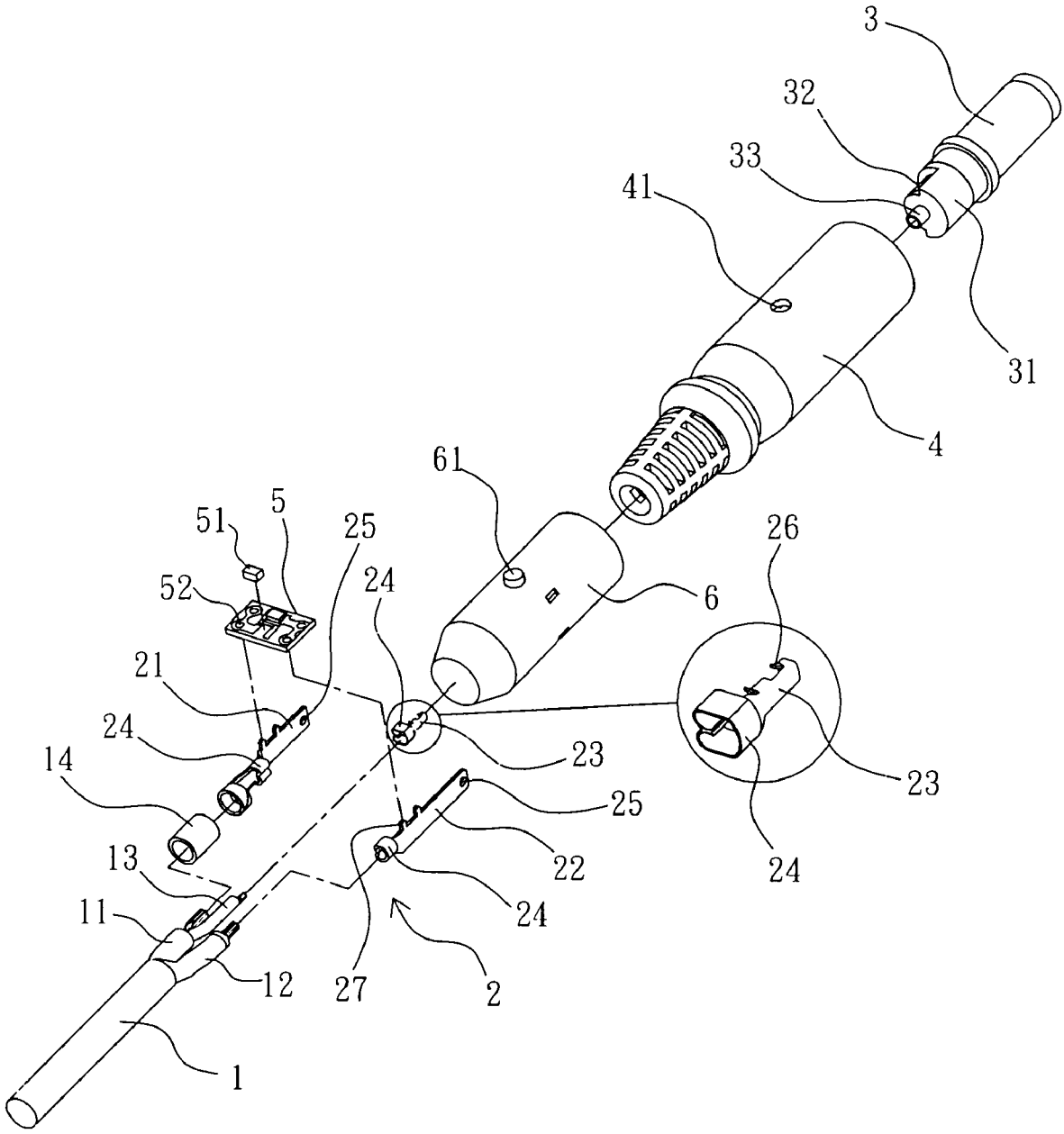
FIG. 2 is a 3D exploded view of the power plug assembly provided by the present invention.

As shown from FIG. 2 to FIG. 7, the power plug assembly provided by the present invention is composed by a cable 1, a terminal set 2, a conductive sleeve tube 3 and an outer covering member 4.

The cable 1 has two power wires 11, 12 and a signal wire 13 can additionally be provided according to actual needs. End sections of the power wires 11, 12 and the signal wire 13 are provided with plural exposed conductive metal wires, e.g. copper wires, so the cable 1 is provided with positive and negative electricity and a function of signal transferring.

Figure 3:
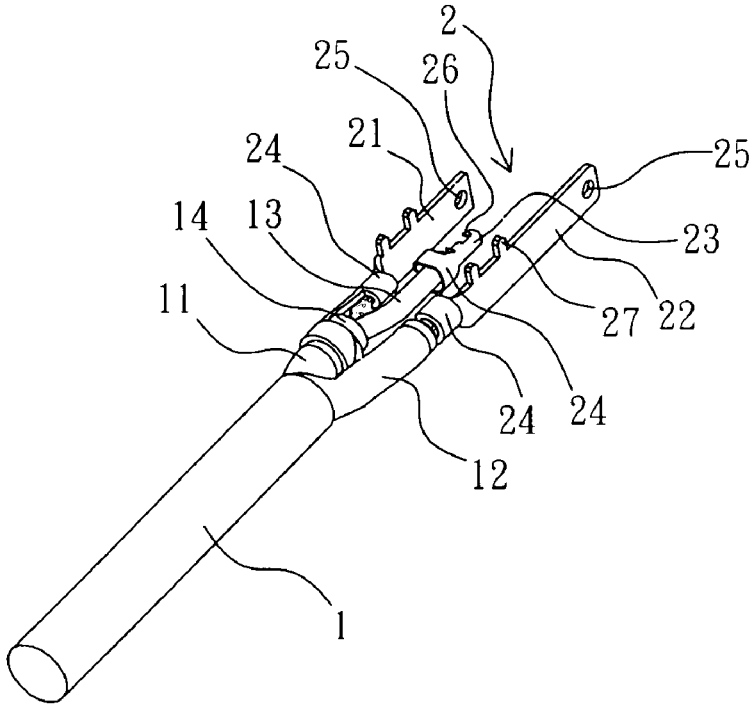
FIG. 3 is a first 3D manufacturing flow chart of the power plug assembly provided by the present invention.

The terminal set 2 is formed by punching and bending metal sheets, such as copper sheets. The amount of terminals of the terminal set 2 is according to the amount of the wires mentioned above; as shown in FIG. 2, the terminal set 2 is composed by a positive terminal 21, a negative terminal 22 and a signal terminal 23. A connecting section 24 is respectively provided to each rear portion of the terminals, the connecting sections 24 are formed by bending and pressing two opposite sheets and are respectively clamped and retained on the corresponding end sections of the power wires 11, 12 and the signal wire 13, and FIG. 3 is schematic view after the assembly mention above. In order to weld the positive terminal 21 and the negative terminal 22 on the conductive sleeve tube 3, the surfaces of the positive terminal 21 and the negative terminal are provided with welding holes 25, so after the two terminals 21, 22 are provided on the corresponding locations of the conductive sleeve tube 3, the welding material can pass through the welding holes 25 then the two terminals 21, 22 are connected and retained on the conductive sleeve tube 3, and a solid connection is therefore obtained and the sizes of the welded tin points are reduced. In order to avoid shortage between the positive terminal 21 and the negative terminal 22, one of the two connecting sections 24, e.g. the connecting section 24 of the positive terminal 21 is sleeved with a thermal contracting tube 14 that is contracted after being heated, the contracting tube 14 is served to cover the connecting section 24 disposed at the rear portion of the positive terminal 21 so an insulating function is provided.

The conductive sleeve tube 3 is a conventional conductive plug, and is provided with an outer tube 31 and an inner tube 32, an insulating material is provided between the outer tube 31 and the inner tube 32 for insulation, the bottom end of the conductive sleeve tube 3 is axially provided with an insulating sleeve 33. When being assembled, the positive terminal 21 and the negative terminal 22 are respectively connected to the rear portions of the inner tube 32 and the outer tube 31, then a welding operation is processed at the welding holes 25 of the two terminals 21, 22, so the two terminals 21, 22 are firmly connected to the conductive sleeve tube 3. A contacting end 26 of the signal terminal 23 is sleeved in the insulating sleeve 33 for being received and positioned at the center of the rear end of the inner tube 32, FIG. 5 is a schematic view of the above mentioned assembly, wherein a printed circuit board 45 shown in the figure and provided between the positive terminal 21 and the negative terminal 22 shall be described later.

Figure 5:
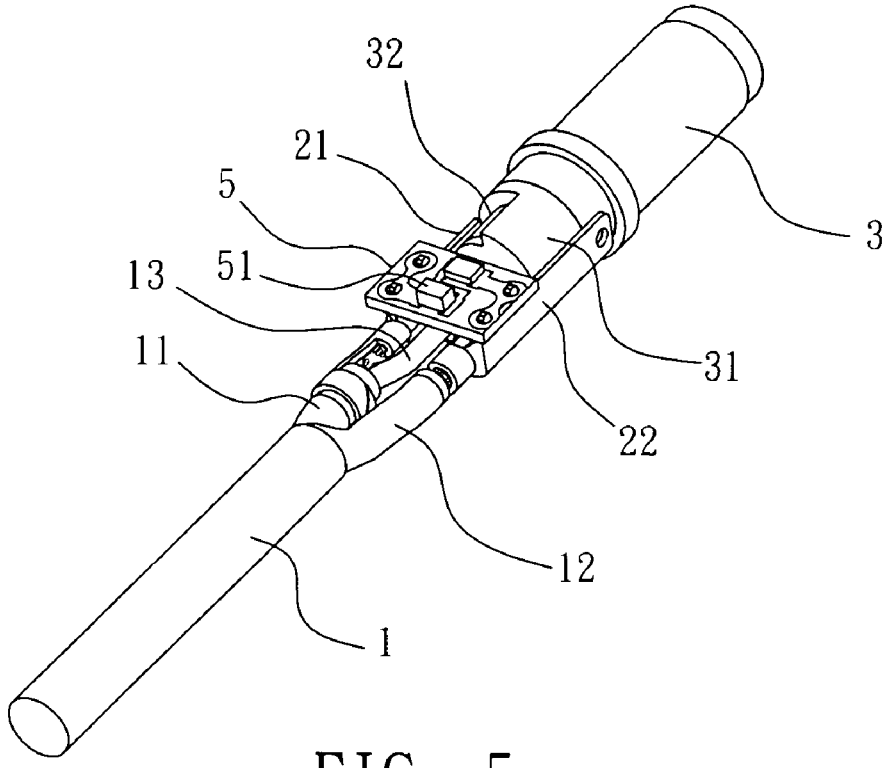
FIG. 5 is a third 3D manufacturing flow chart of the power plug assembly provided by the present invention.
Figure 7:
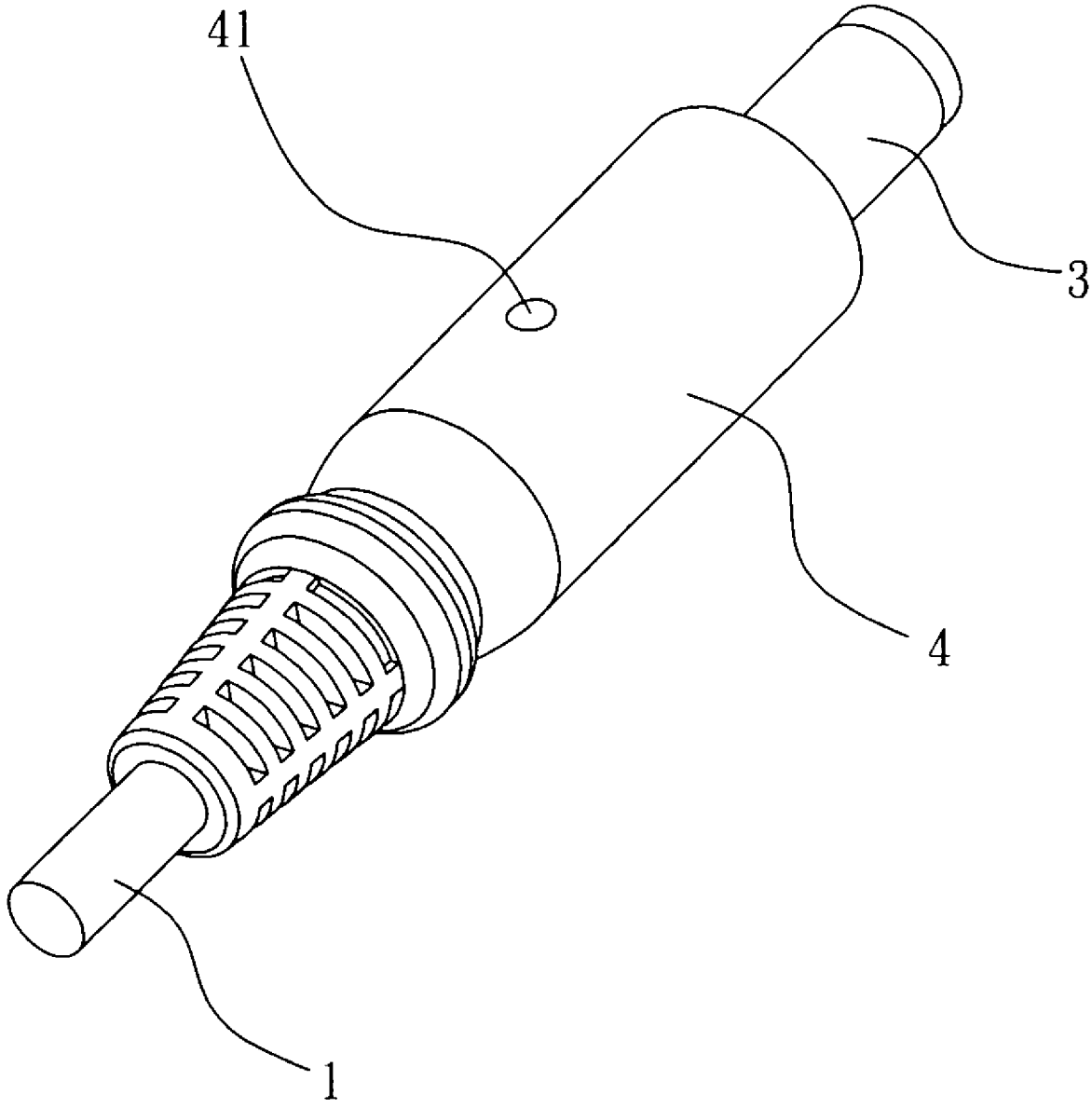
FIG. 7 is a fifth 3D manufacturing flow chart of the power plug assembly provided by the present invention.

The outer covering member 4 is a solid member formed by a plastic injection molding, if the power plug assembly provided by the present invention is desired to be manufactured, a semi-finished goods as shown in FIG. 5 is placed in a mold for plastic injection, then the rear portion of the conductive sleeve tube 3, the terminal set 2 and the front portion of the cable 1 are covered by the outer covering member 4 via the embedded-type plastic injection molding, so a finished goods as shown in FIG. 7 is obtained.

With the above described embodiment provided by the present invention, the over-size welding points caused by directly welding the wires of the cable on the conductive sleeve tube can be avoided, and the spread-out of the copper wires of the wires caused by being pressed by welding tools in an welding operation can also be avoided; so the connecting strength, the welding speed are increased, the defective rate is thus lower and the quality can be ensured.

Figure 4:
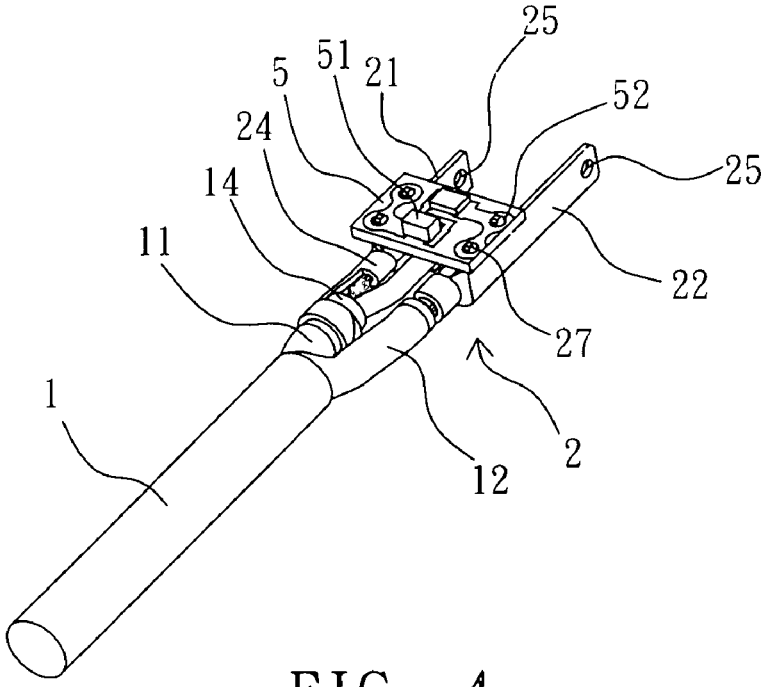
FIG. 4 is a second 3D manufacturing flow chart of the power plug assembly provided by the present invention.

Referring from FIG. 2 to FIG. 7, in order to provide more relative functions to the power plug assembly provided by the present invention, e.g. indication or detection, a printed circuit board 5 can be further provided between the positive terminal 21 an the negative terminal 22, the circuit of the printed circuit board 5 is coupled with a functional electronic unit 51, such as a LED, and the functional electronic unit 51 can also be, but not limited, to an integrated circuit (IC) that can provide relevant functions according to customers' demands, e.g. a detecting function. At least one retaining member 27, e.g. a tenon, is respectively provided to the positive terminal 21 and the negative terminal 22, and with respect to the locations of the retaining members 27 of the two terminals 21, 22, the printed circuit board 5 is provided with sheet holes 52, so an welding operation can be processed after the printed circuit board 5 is embedded and positioned, the above mentioned assembly is shown in FIG. 4. The positive terminal 21 and the negative terminal 22 can be served to supply power to the printed circuit board 5 so the printed circuit board 5 can be operated.

If the functional electronic unit 51 is a LED, after a semi-finished goods as shown in FIG. 4 is connected to a conductive sleeve tube 3, the assembly is as shown in FIG. 5. The semi-finished goods shown in FIG. 5 is then placed in a mold for plastic injection, a first operation of embedded-type plastic injection molding is processed so the rear portion of the conductive sleeve tube 3, the printed circuit board 5, the terminal set 2 and the front portion of the cable 1 are all covered within a transparent inner covering member 6, so a semi-finished goods as shown in FIG. 6 is obtained, and a transparent column 61 is provided to the inner covering member 6 with respect to the location of the above mentioned LED.

Figure 6:
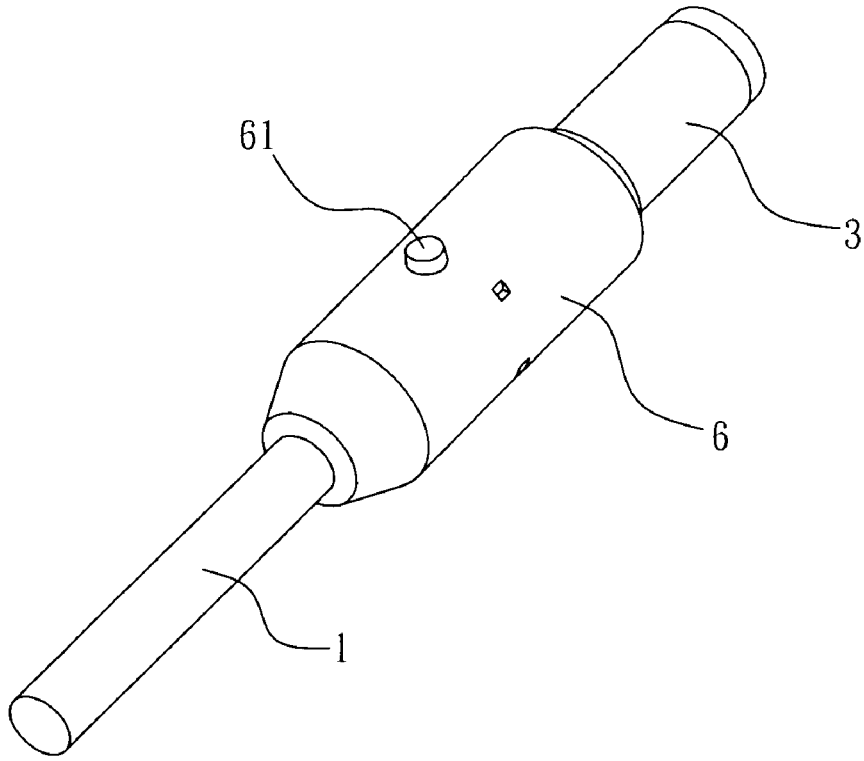
FIG. 6 is a fourth 3D manufacturing flow chart of the power plug assembly provided by the present invention.

As shown in FIG. 7, a second operation of embedded-type plastic injection molding is processed on the semi-finished goods shown in FIG. 6 so the inner covering member 6 is covered by an opaque outer covering member 4 and a window hole 41 is formed at the location of the transparent column 61 thus the transparent column 61 is disposed within the window hole 41.

When the power plug assembly provided by the present invention is plugged to a power-receiving plug of an electronic unit, e.g. a note book computer, the circuit is established so the LED is lit up and the LED light emits out via the transparent column 61 within the window hole 41 for being served as a power indication.

As mentioned above, the functional electronic unit 51 is not limited to a LED, if a charging detection IC is provided, the IC can be served as a charging detection.

With the second embodiment of the present invention, in addition to the welding function, the positive and the negative terminals can be further provided with a printed circuit board or an functional electronic unit, so the power plug assembly can not only be served to supply power but also be served as an indication or a detection device.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power plug assembly, comprises a cable having two power wires, end sections of each wire has plural conductive metal wires;

a terminal set composed by a positive terminal and a negative terminal, a connecting section is respectively provided to the rear portions of the two terminals and the connecting sections are respectively connected to plural conductive metal wires at the end sections of the power wires, the surfaces of the positive and the negative terminals are provided with welding holes;

a conductive sleeve tube having an inner tube and an outer tube, an insulating material is provided between the inner tube and the outer tube for insulation; after the two terminals are respectively provided on the outer tube and the inner tube of the conductive sleeve tube, a welding operation is processed and the welding material passes through the welding holes so the two terminals are connected and retained on the conductive sleeve tube; and an outer covering member formed by a plastic injection molding and the rear portion of the conductive sleeve tube, the terminal set and the front portion of the cable are covered by the outer covering member.

2. The power plug assembly as claimed in claim 1, wherein the cable is further provided with a signal wire, the end section of the signal wire has plural conductive metal wires; the terminal set is further provided with a signal terminal, the rear portion of the signal terminal is provided with a connecting section and the front portion of the signal terminal is provided with a contacting end, the connecting section is connected to the plural conductive metal wires provided at the end section of the signal wire; an insulating sleeve is axially provided at the bottom end of the conductive sleeve tube, the contacting end of the signal terminal is sleeve in the insulating sleeve for being received and positioned at the rear end of the conductive sleeve tube.

3. The power plug assembly as claimed in claim 1, wherein each of the connecting section is formed by punching and pressing two opposite sheets.

4. The power plug assembly as claimed in claim 2, wherein each of the connecting section is formed by punching and pressing two opposite sheets.

5. The power plug assembly as claimed in claim 1, wherein either of the connecting section of the positive terminal or the connecting section of the negative terminal is provided with a thermal contracting tube, the rear portion of the terminal provided with the thermal contracting tube is covered by the thermal contracting tube after the thermal contracting tube is heated then contracted, so the terminal provided with the thermal contracting tube will not be in contact with the other terminal.

6. A power plug assembly, comprises:

a cable having two power wires, end sections of each wire has plural conductive metal wires;

a terminal set composed by a positive terminal and a negative terminal, a connecting section is respectively provided to the rear portions of the two terminals and the connecting sections are respectively connected to plural conductive metal wires at the end sections of the power wires, the surfaces of the positive and the negative terminals are provided with welding holes;

a printed circuit board provided across the positive and the negative terminals so as to establish a circuit, and the circuit is coupled with a functional electronic unit a conductive sleeve tube having an inner tube and an outer tube, an insulating material is provided between the inner tube and the outer tube for insulation; after the two terminals are respectively provided on the outer tube and the inner tube of the conductive sleeve tube, a welding operation is processed and the welding material passes through the welding holes so the two terminals are connected and retained on the conductive sleeve tube; and an outer covering member formed by a plastic injection molding and the rear portion of the conductive sleeve tube, the terminal set and the front portion of the cable are covered by the outer covering member.

7. The power plug assembly as claimed in claim 6, wherein at least one retaining member is respectively provided to the positive and the negative terminals for being connected to the printed circuit board.

8. The power plug assembly as claimed in claim 7, wherein the retaining members are tenons, and with respect to the locations of the tenons the printed circuit board is respectively with sheet holes, so after the printed circuit board is embedded and positioned, a welding operation is processed for connection.

9. The power plug assembly as claimed in claim 6, wherein the functional electronic unit is a LED; before being covered by the outer covering member, the rear portion of the conductive sleeve tube, the terminal set, the printed circuit board and the front portion of the cable are covered by a transparent inner covering member, and a transparent column is provided to the inner covering member with respect to the location of the LED; a window hole is provided to the outer covering member with respect to the location of the transparent column so the LED light can emit to outside via the transparent column.

10. The power plug assembly as claimed in claim 6, wherein the functional electronic unit is an integrated circuit.

11. The power plug assembly as claimed in claim 6, wherein the cable is further provided with a signal wire, the end section of the signal wire has plural conductive metal wires; the terminal set is further provided with a signal terminal, the rear portion of the signal terminal is provided with a connecting section and the front portion of the signal terminal is provided with a contacting end, the connecting section is connected to the plural conductive metal wires provided at the end section of the signal wire; an insulating sleeve is axially provided at the bottom end of the conductive sleeve tube, the contacting end is sleeve in the insulating sleeve for being received and positioned at the rear end of the conductive sleeve tube.

12. The power plug assembly as claimed in claim 6, wherein each of the connecting section is formed by punching and pressing two opposite sheets.

13. The power plug assembly as claimed in claim 11, wherein each of the connecting section is formed by punching and pressing two opposite sheets.

14. The power plug assembly as claimed in claim 6, wherein either of the connecting section of the positive terminal or the connecting section of the negative terminal is provided with a thermal contracting tube, the rear end of the terminal is covered by the thermal contracting tube after the thermal contracting tube is heated then contracted, so the terminal will not be in contact with the other terminal.

* * * * *